United States Patent [19]

Aamodt

[11] Patent Number: 4,506,568

[45] Date of Patent: Mar. 26, 1985

[54] OIL FILTER WRENCH

[76] Inventor: Norman O. Aamodt, R.D. #5, Coatesville, Pa. 19320

[21] Appl. No.: 504,935

[22] Filed: Jun. 16, 1983

[51] Int. Cl.[3] ..... B25B 13/52

[52] U.S. Cl. ..... 81/64

[58] Field of Search ..... 81/64, 3.43; 24/481–484, 456, 19, 20 R, 20 TT, 269, 279–280, 115 R, 115 L

[56] References Cited

U.S. PATENT DOCUMENTS

| | | | |
|---|---|---|---|
| 2,557,877 | 6/1951 | Kluson | 24/115 R X |
| 2,611,164 | 9/1952 | Meighan et al. | 24/269 |
| 3,728,916 | 4/1973 | Brantley | 81/64 |
| 3,962,936 | 6/1976 | Lewis | 81/64 |

FOREIGN PATENT DOCUMENTS

| | | | |
|---|---|---|---|
| 1802393 | 8/1969 | Fed. Rep. of Germany | 81/64 |

*Primary Examiner*—Frederick R. Schmidt
*Assistant Examiner*—Debra S. Meislin

[57] ABSTRACT

A strap wrench especially designed for removing oil filters. Both ends of the strap are retained in the wrench body and this forms a loop of the strap which passes around the oil filter. By applying a twisting action to the wrench body, the oil filter can be loosened with a minimum of torque applied to the wrench. The strap wrench comprises a strap structure which has its two ends formed into a loop structure. The two ends of the strap pass through both parts of a two-part holder structure. The two-part holder structure has one part inside the second part. Rotation of the inside part of the holder will lock the ends of the strap to the holder and further rotation of the holder then causes the strap to rotate the oil filter held in the loop of the strap.

4 Claims, 3 Drawing Figures

OIL FILTER WRENCH

BACKGROUND OF THE INVENTION

1. Field of the Invention

The invention is directed to a strap wrench and, more particularly, to a strap wrench especially designed for removing oil filters on cars.

2. Description of the Prior Art

U.S. Pat. No. 3,962,936 discloses a strap wrench which has both ends of a flexible strap readily secured in the body of the wrench. The strap is held in the body of the wrench primarily due to the frictional wrapping of the strap around the wrench body.

U.S. Pat. No. 3,728,916 discloses a strap wrench for oil filters in which the body of the wrench is formed of a two-part structure with one end of the strap being grasped between the two parts of the wrench body structure.

SUMMARY OF THE INVENTION

The strap wrench comprises a strap structure which has its two ends formed into a loop structure. The two ends of the strap pass through both parts of a two-part holder structure. The two-part holder structure has one part inside the second part. Rotation of the inside part of the holder will lock the ends of the strap to the holder and further rotation of the holder then causes the strap to rotate the oil filter held in the loop of the strap.

DESCRIPTION OF THE PREFERRED EMBODIMENTS

Figure 1:
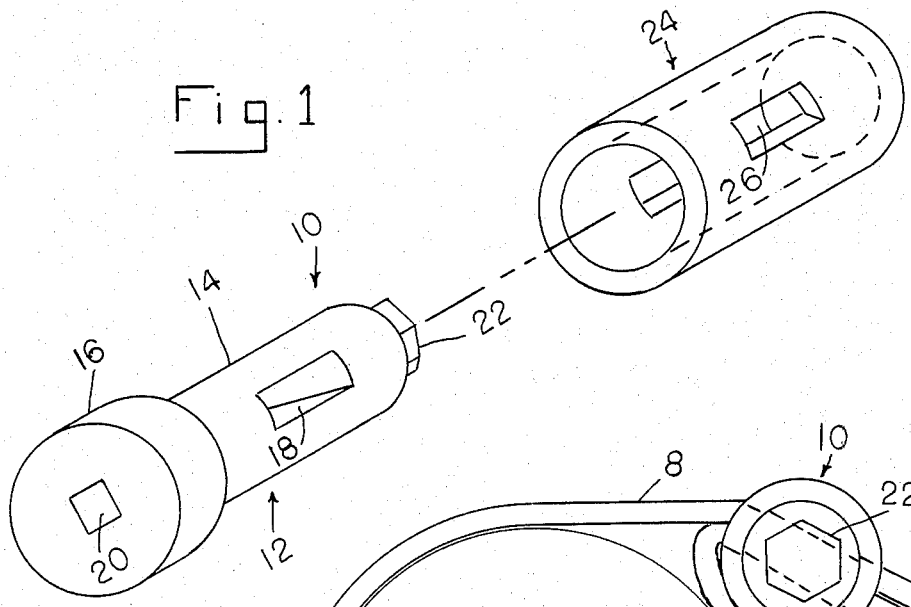
FIG. 1 is an exploded, perspective view of the wrench holder.

The invention is directed to a strap wrench adapted for use on oil filters. The strap of the wrench is adapted to encircle a typical oil filter 2 (see FIG. 2) and the two ends 4 and 6 of the strap wrench are positioned in a side-by-side relationship for a short distance. The strap 8 is approximately one-half to two inches wide and fourteen to thirty inches long. The strap is formed from conventional leather, fiber or plastic-covered fiber material which will tend to frictionally grip the outside surface of an oil filter. Corrugations can be provided on the inside of the strap to enhance gripping. A holder 10 is provided for the two ends of the strap. The holder is formed from a first part 12 which is cylindrical in shape with a body portion 14 and an enlarged head 16. Passing through the mid-region of the body portion 14 is a slot 18. On the enlarged head there is positioned a slot 20 which will receive the drive end of a $\frac{1}{4}''$, $\frac{3}{8}''$ or $\frac{1}{2}''$ standard or metric socket wrench and on the opposite end of the first part 12 is a six-sided nut head 22 which will receive a conventional socket, open end or box wrench. Consequently, the part 12 can be made to rotate around the longitudinal axis of its body through the use of either a socket type wrench, a ratchet wrench or a standard wrench being positioned on one or the other end of the body member.

The second part of the holder is part 24 which is a cylindrical tube. The outside diameter of the tube is approximately equal to the outside diameter of the head

Figure 2:
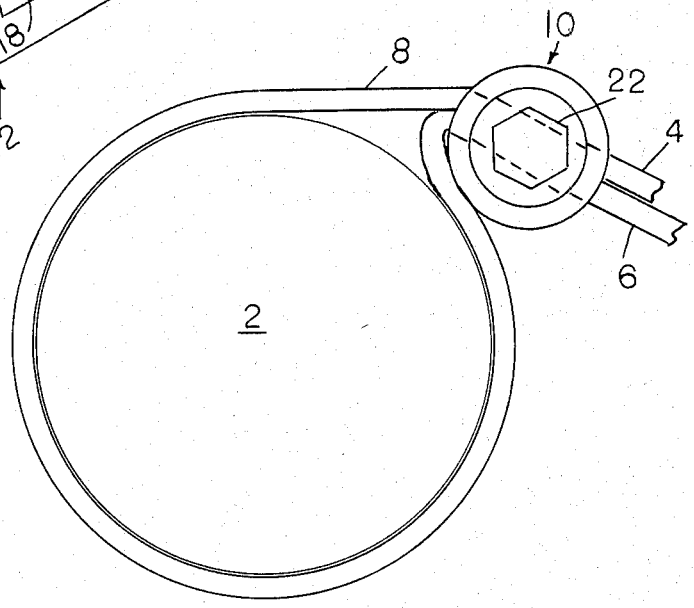
FIG. 2 is one embodiment of the wrench structure in use.

16 and the inside diameter of the tube is slightly bigger than the outside diameter of body 14. Part 24 has a slot 26 which passes through both walls of the part in alignment in the mid-region thereof. When the part 12 is inserted into the part 24, and the head 16 rests against the end of the body member 24, the slots 18 and 26 are in alignment. The slots are sized such that there is just enough room to pass therethrough the two side-by-side positioned ends of the strap structure as shown in FIG. 2. When the first part is positioned in the second part and the strap ends are in the slot, rotation of the part 12 due to the hex-head 22 will first cause a slight rotation of part 12 relative to part 24 and this will lock the ends of the strap in position in the slot so that they cannot be pulled out of the slot. Continued rotation of the head 22 will then draw the strap around the holder slightly as shown in FIG. 2 and this subsequently will then cause rotation of the oil filter to cause the oil filter to be tightened to or loosened from a car engine.

Figure 3:
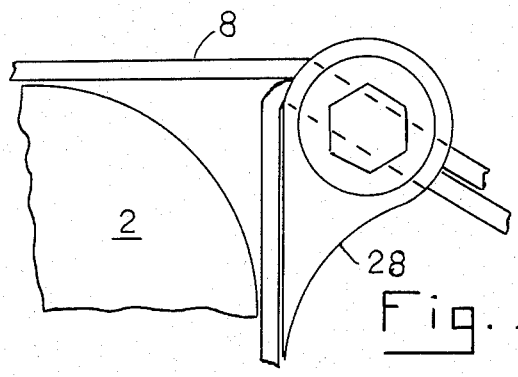
FIG. 3 is another embodiment of the wrench structure in use.

FIG. 3 shows a modification of the structure of FIG. 2 wherein the part 24 is provided with a fulcrum arm 28 to press against the side of an oil filter and the strap to assist in the gripping of the strap to the oil filter.

What is claimed is:

1. A strap wrench adapted for use on oil filters comprising:

(a) a strap adapted to encircle a typical oil filter with its two ends being in a side-by-side relationship for a short distance; and (b) a holder for the two ends of the strap in their side-by-side relationship, said holder having means adapted to be gripped with a wrench, said holder being in two parts comprising:

(1) a first part being a cylindrical part with a midregion and with means on at least one end thereof to be gripped with a wrench, said cylindrical part having a longitudinal axis and a slot which passes through the midregion of the cylindrical part perpendicular to the longitudinal axis;

(2) a second part being a cylindrical tube with opposite walls with a longitudinal axis and having an opening therein along the longitudinal axis with the opening being slightly larger than the size of the cylindrical part of the first part, said second part has a slot passing through both opposite walls thereof in its midregion perpendicular to the longitudinal axis;

(3) said first part being positioned within said second part with the slots therein being in alignment and the side-by-side ends of the strap being positioned to pass through said slots and draw the strap tightly around the oil filter; and (4) the size of the slots are approximately equal to or slightly larger than the thickness of the two side-by-side strap ends and the width of the strap ends;

(5) said first and second parts coacting whereby rotation of the first part relative the second part locks the ends of the strap in the now misaligned slots of the first part and the second part; and (6) said second part has a fulcrum arm projecting from the cylindrical part of the second part, said fulcrum arm functions as a means to engage the outside of the strap to press the inside of the strap against the side of the oil filter body and to allow for relative rotation between the first and second parts.

2. The strap wrench of claim 1 wherein one end of the first part has the means on at least one end thereof being a slot to receive an end of a ratchet wrench.

3. The strap wrench of claim 2 wherein the other end of the first part also has a means on at least one end thereof being an enlarged six-sided head to receive a conventional socket wrench.

4. The strap wrench of claim 1 wherein the strap has a corrugated inner surface to enhance gripping.

* * * * *